United States Patent [19]

Struben

[11] Patent Number: 4,570,396

[45] Date of Patent: Feb. 18, 1986

[54] ROOF STRUCTURE FOR MOBILE HOMES

[76] Inventor: Francis L. Struben, 3870 Jarrettsville Pike, Jarrettsville, Md. 21062

[21] Appl. No.: 550,089

[22] Filed: Nov. 9, 1983

[51] Int. Cl.[3] ..... E04B 7/02

[52] U.S. Cl. ..... 52/90; 52/410; 52/94; 52/199

[58] Field of Search ..... 52/408, 409, 410, 90, 52/86, 506, 508, 404, 407, 93, 94

[56] References Cited

U.S. PATENT DOCUMENTS 3,796,014 3/1974 Garbrick ..... 52/90 X

FOREIGN PATENT DOCUMENTS 2051910 1/1981 United Kingdom ..... 52/410

*Primary Examiner*—Carl D. Friedman

*Attorney, Agent, or Firm*—Walter G. Finch

[57] ABSTRACT

The invention is an improved roof structure for trailer or mobile type homes. The roof structure of this invention is affixed to a mobile home directly over an existing roof structure on the trailer or mobile type home. The improved roof structure of this invention may be used to provide additional insulating properties and to save energy. A greater value and use of the present invention is that it is designed to be affixed directly over the existing roof of the trailer or mobile type home without removing the old roof. This is cost effective and is especially useful when the existing roof needs repairs or has deteriorated to a point where it must be completely replaced. The improved roof structure consists of a fabricated longitudinal center support member, two intermediate longitudinal roof support members, when the beam spread is excessive, two soffit support members, a plurality of roof panel members, special eave members, a plurality of insulation panel members, special gable end enclosures, and a plurality of suitable fasteners and connectors.

10 Claims, 11 Drawing Figures

FIG. 7
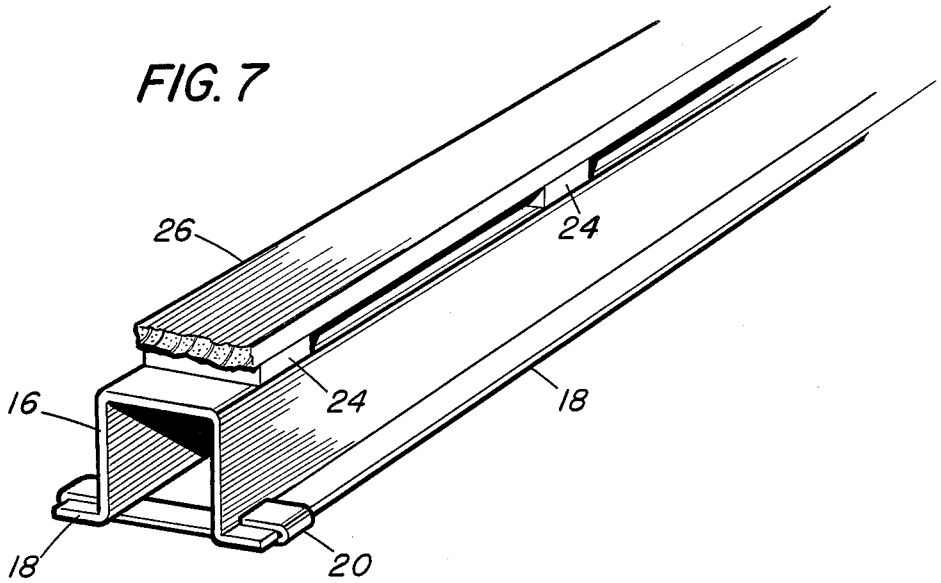
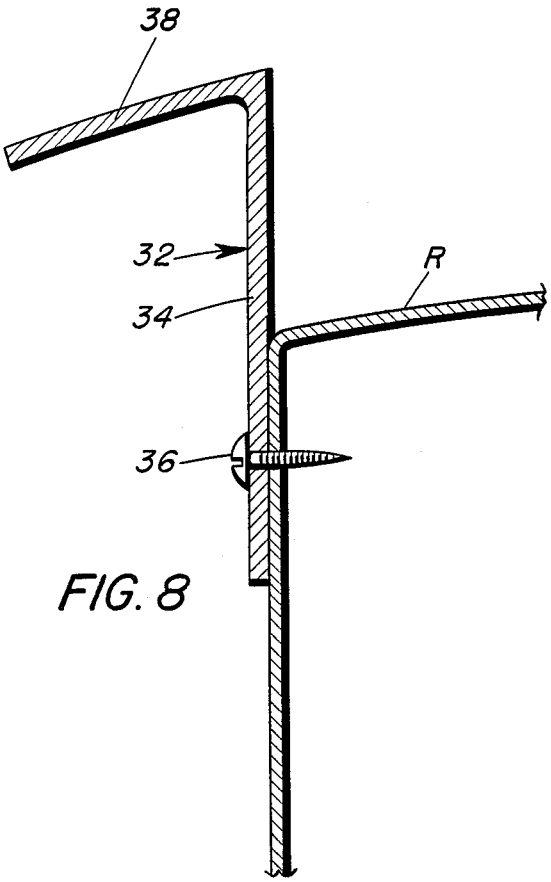
FIG. 8
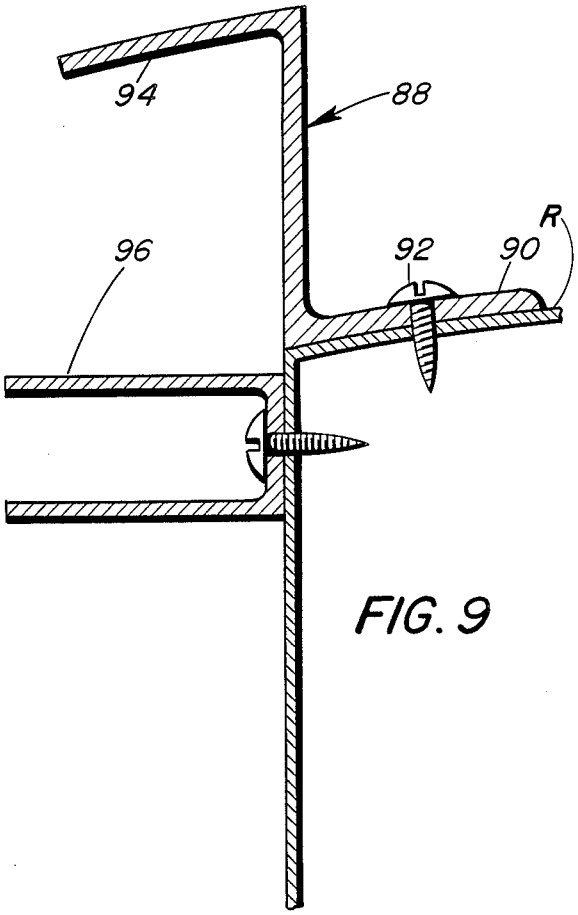
FIG. 9

ROOF STRUCTURE FOR MOBILE HOMES

BACKGROUND AND SUMMARY OF THE INVENTION

The invention relates to roofs and in particular to roofs for trailer and mobile type homes. Specifically, it relates to replacement roofs for trailer or mobile type homes for installation directly over an existing curved-type or camper-type roof on a trailer or mobile-type home, sometimes referred to as an arc-like or arched roof.

It is to be understood that the use of the roof structure of this invention over flat type roofs or other type roofs to which it can be adapted, is within the scope and intent of this invention.

It is also to be understood that it is within the scope and intent of this invention to utilize the structure of this invention to provide an initial or original roof on a building, mobile type homes, as well as for travel trailers and modular or manufactured homes.

In reality, when installed on a trailer or mobile-type home over a curved or arc-like roof, it is an "additional roof" with many advantages, as will be explained hereinafter.

The structure of the invention recognizes and takes heed of the old adage that "when you insulate, remember to ventilate". The roof structure of this invention allows air to circulate through its unique and novel ventilated roof panel arrangement and soffit system.

Additional insulation is installed over the old roof of the trailer or mobile-type home, such as polystyrene or fibre-glass. This additional insulation further enhances the value of a roof structure as provided by this invention.

The roof structure may be made of various materials, however, aluminum is the preferred material to provide a light-weight, maintenance-free roof. The prior art necessity for painting the roof with short-life roof coatings is eliminated.

As will be described later, the cross sectional configuration of the roofing panels, or "skin" of the roof, is rigid-formed and curved. This rigid forming and curvature reduces the rumble which is characteristic of the prior art trailer and mobile-type home roofs when the wind blows. The roofing panels are interlocked to form a weather-tight roof that will repel rain, ice, and snow. The double structure, formed by the present structure over the existing roof of a trailer or mobile-type home also insulates against noise. The insulation also eliminates noise from rain and hail.

The improved structure of the present roof of this invention, as described hereinafter, insulates so that the building is warmer in cold weather and cooler in warm or hot weather, thus saving on energy costs.

While air can flow naturally through the unique and novel configuration of the roof panels from one eave to the other, the unique and novel design of incorporating an interior exhaust fan will cause air flow across the underside of the roof panels when little or no wind is moving naturally outside of the trailer or mobile type home.

Special eave members are provided that permits one to be utilized as a rain gutter, and the other for an eave cover that permits leaves and similar debris to fall through instead of building up.

It is, therefore, an object of this invention to provide a roof structure that can be used on trailers and mobile-type homes.

It is another object of this invention to provide a roof structure that can be easily mounted over and affixed to an existing roof structure having a curved or arc-like configuration.

It is a further object of this invention to provide a roof structure that has a soffit and roof panel ventilating system.

It is still another object of this invention to provide a roof structure that is easily installed.

It is still another object of this invention to provide a structural roof design which can be transported.

Further objects and advantages of the invention will become more apparent in light of the following description of the preferred embodiments.

BRIEF DESCRIPTION OF THE DRAWINGS

FIG. 7 is an enlarged partial perspective view of a fabricated longitudinal support member;

FIG. 8 is an enlarged cross-sectional view of a soffit support at an eave;

FIG. 9 is an enlarged cross-sectional view of a modified soffit support at an eave;

DESCRIPTION OF THE PREFERRED EMBODIMENTS

Figure 1:
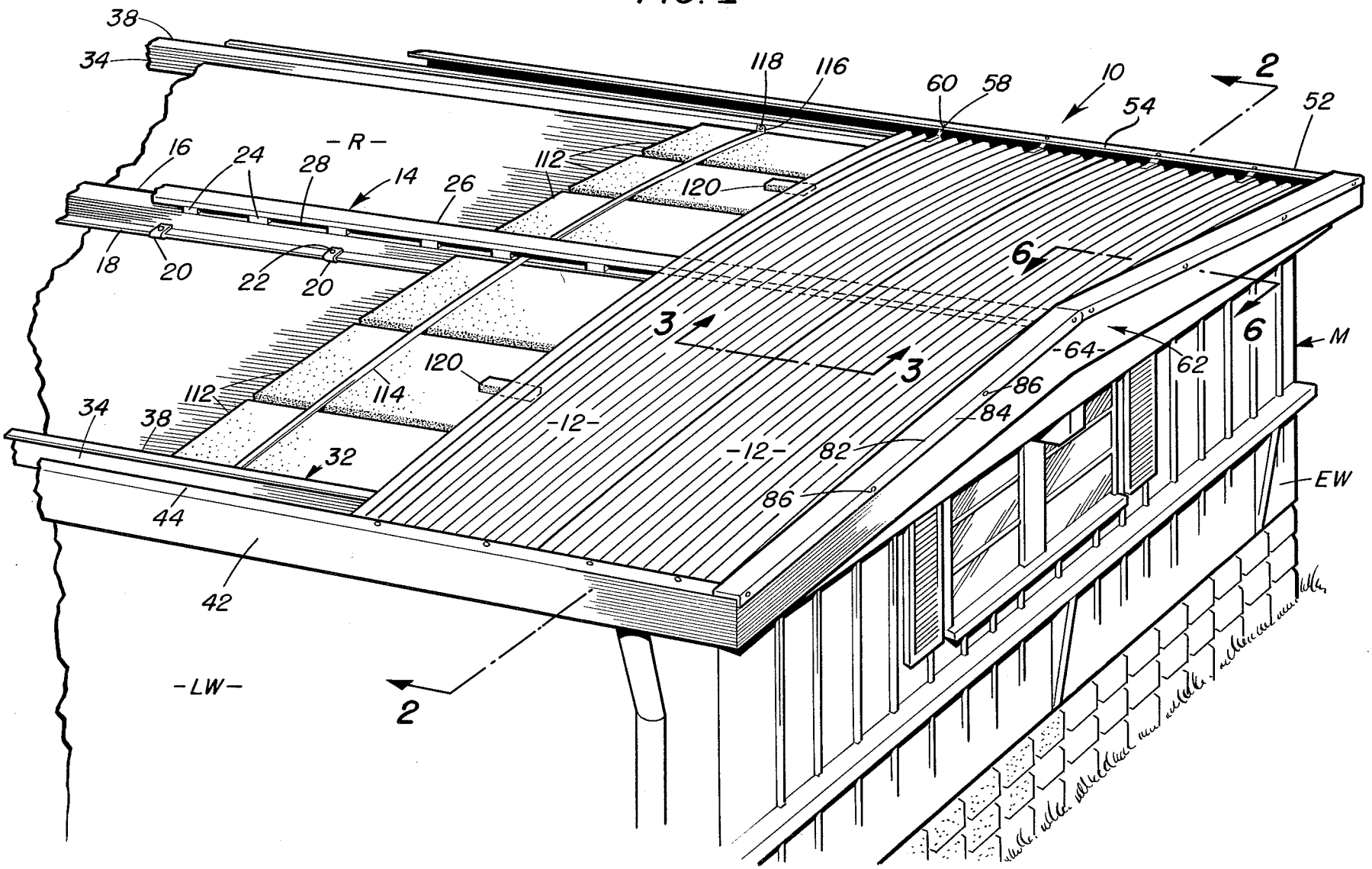
FIG. 1 is a partial perspective view of a roof structure applied to a mobile-type home.

Referring now to the drawings, and particularly to FIG. 1, a roof structure for mobile homes is shown at 10. It is to be noted that while this roof structure for mobile homes 10 may be used as an original roof, the primary use is as a replacement roof for installation over an original or existing roof R as shown in FIG. 2.

Figure 2:
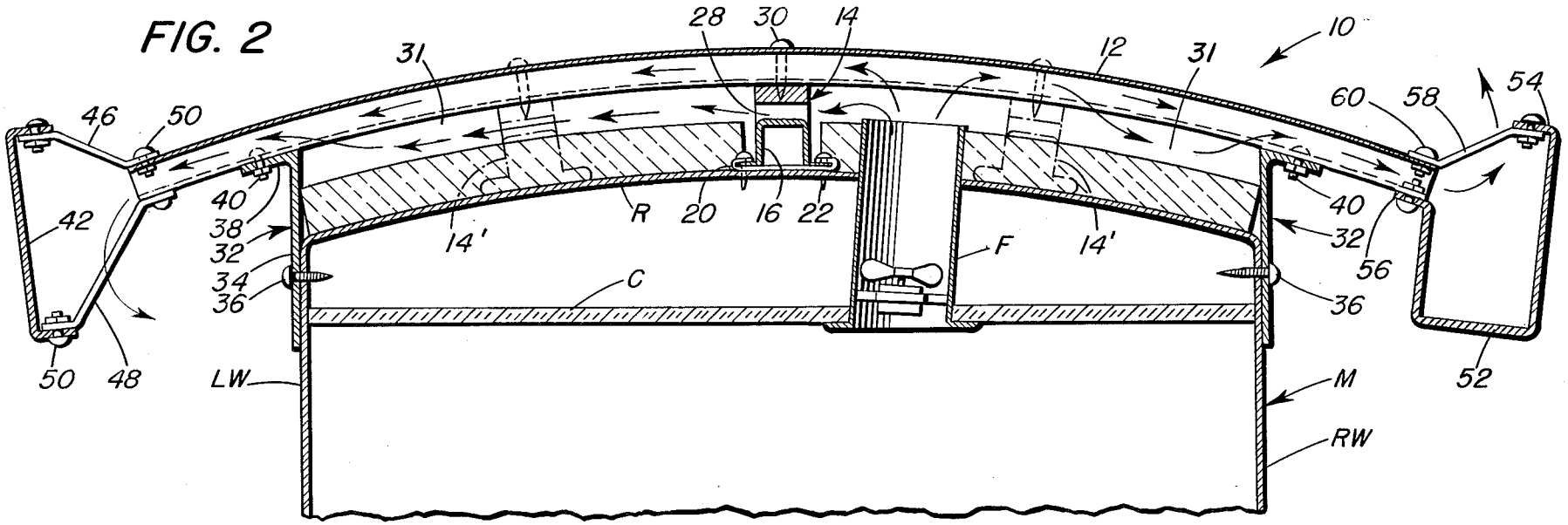
FIG. 2 is an enlarged cross-sectional view taken on line 2—2 of FIG. 1.

It is also to be noted that the scale of FIG. 2 is exaggerated, because of space limitations, so that all details are discernable.

Figure 6:
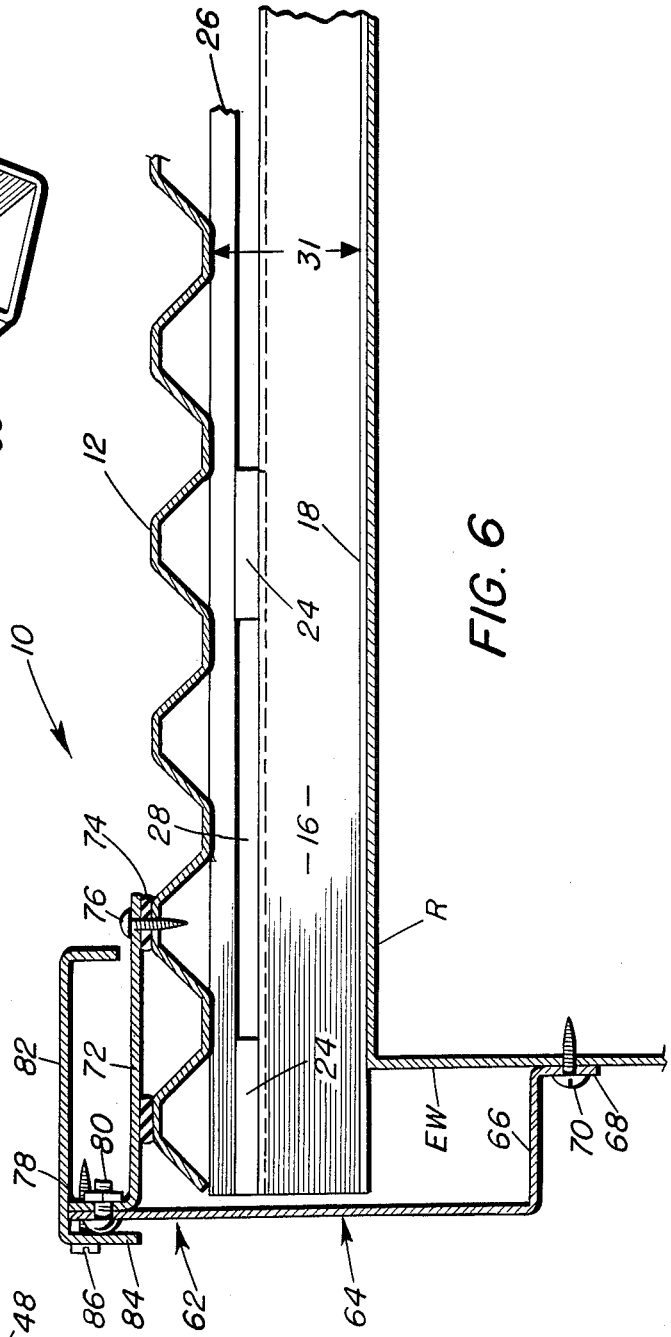
FIG. 6 is a partial longitudinal sectional view through an end gable taken on line 6—6 of FIG. 1.

As noted hereinbefore, the primary use of the roof structure for mobile homes 10 is as a replacement roof for a mobile home. In FIGS. 1, 2, 3, 6, 8, and 9, portions of such a mobile home M are indicated. The mobile home M (FIG. 1) has a roof R, a left wall LW, and an end wall EW. In FIG. 2 the mobile home M has the roof R, the ceiling C, a left wall LW, a right wall RW, and an exhaust fan F through the ceiling C and roof R. The roof R is also shown in FIGS. 3, 6, 8, and 9. The end wall EW is also shown in FIG. 6.

The roof structure for mobile homes 10 consists primarily a longitudinal support means 14, a pair of longitudinal soffit support means 32, a plurality of roof panels 12, and a plurality of insulation panels 112.

When the beam width or span of the roof R is large, at least two intermediate longitudinal support means 14' may be added. The longitudinal support means 14 and intermediate longitudinal support means 14' run the longitudinal length of the roof R. Such additional longitudinal support means 14' may be added when the old roof condition is poor or for other reasons.

The longitudinal support means 14 and the intermediate longitudinal support means 14' are fabricated. Each has a flanged 18 channel member 16 in a more or less hat-like shape, a stringer 26 preferably of wood, a plurality of spacer blocks 24 which may be of wood or metal, preferably of wood, a plurality of cleats 20 and a plurality of suitable fastener means as described hereinafter.

The stringer 26 is suitably affixed to spacer blocks 24, such as by nailing, and the resulting assembly is suitably affixed to the longitudinal support means 14 (or intermediate longitudinal support means 14'), such as by bolts. The fabricated longitudinal support means 14 is then centrally located and suitably affixed 22 to the roof R of the mobile home M, such as by sheet metal screws, through a plurality of cleats 20. It is to be noted that the fastening means 22 may pass through both the cleat 20 and the flanges 18 of the channel member 16. Similar fabrication and affixing means also apply to any uses of the intermediate longitudinal support 14'.

The locating and affixing of intermediate longitudinal support means 14' is similar to the centrally located longitudinal support means 14. Hereinafter, reference will only be made to the longitudinal support means 14.

It is also to be noted that additional stringers 26 may be located and affixed on top of the first stringer 26 if additional height is required, and that this modification is within the scope and intent of the invention.

The wood stringer 26 has an insulating effect and prevents condensation forming such as would occur if the roof panels 12 were in a metal to metal contact. The stringer 26 may be of several lengths in order to extend the longitudinal length of the roof R. Likewise, the longitudinal support means 14 may be in several lengths to facilitate application and installation to an exceptionally long longitudinal length of roof R.

The longitudinal support means 14 with flanges 18 may be extruded in one monolithic piece or may be fabricated from sheet material bent to the hat-like shape.

The cleats 20 also may be cut from an extruded length or may be individually formed by bending. When shaped as shown in the drawings with a clip-like bend at each end they are assembled to the flanges 18 of the hat-like shape of the longitudinal support means 14, spaced apart thereon and then held in place by fastening means 22 as hereinbefore described. It is to be understood that if the fastening means 22 is to be assembled through both the cleat 20 and then into the roof R, the assembly elements may be predrilled to accept the fastening means 22. However, it is also to be understood that fastening through the cleat 20 and directly to roof R and predrilled as an assembly is also within the scope and intent of this invention.

Likewise, it is also within the scope and intent of this invention to form one or both ends of cleat 20 in the field into the clip-like ends.

The spacer blocks 24 are spaced apart along stringer 26 so as to form a plurality of openings 28 between the stringer 26 and the top of the hat-like shape of the longitudinal support means 14. The plurality of openings 28 is for the purpose of permitting the circulation of air therethrough and across the transverse width of the roof structure for mobile homes 10. The circulation of air is shown by the arrows in FIG. 2 as passing through the opening 28 and the air space 31 under the roof panels 12. The air circulation is also shown in FIG. 2 as passing through openings created by the trough-like configuration of the roof panels 12 (which can be seen in FIG. 3).

The circulation of air shown by arrows in FIG. 2 is indicated as when coming from and being caused by the fan F. However, it is to be understood that a natural circulation of air in one direction or in alternate directions through the roof structure for mobile homes 10 is within the scope and intent of this invention; in which case the arrows would run alternately in one direction or the other.

The soffit support angles 32 may be monolithically formed by extrusion or fabricated by bending. They have a less than 90° angle at the uppermost end between the web 34 and the flange 38 so as to accommodate the slope of the curved roof panels 12 as shown in FIG. 2.

The soffit support angles 32 are suitably affixed one to the left wall LW and one to the right wall RW of mobile home M. They are affixed to the mobile home M by suitable fastening means 36, such as sheet metal screws. The preparations for the fastening means 36 may be predrilled or drilled in the field. The soffit angles 32 may be in a plurality of lengths for extra long mobile homes M.

Figure 3:
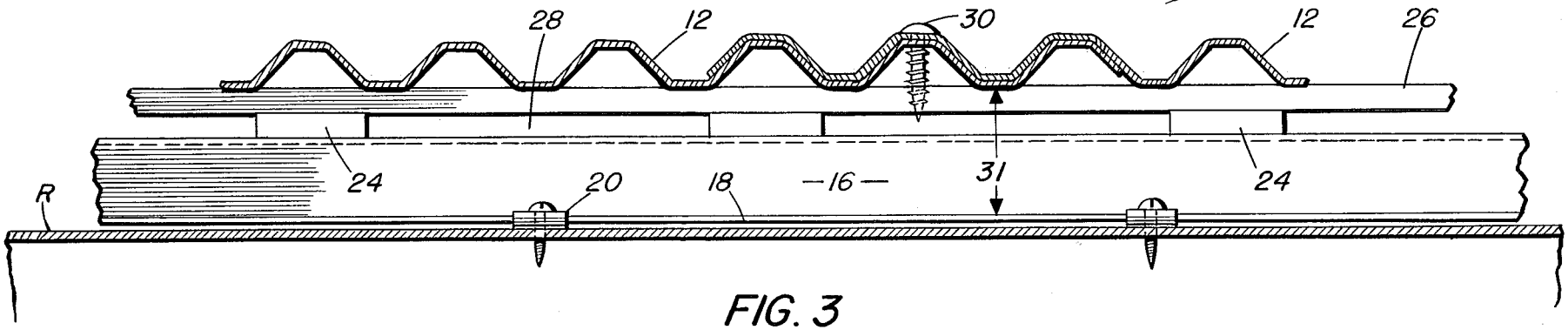
FIG. 3 is a partial longitudinal sectional view taken on line 3—3 of FIG. 1.

The plurality of roof panels 12 overlap each other, as shown in FIG. 3, when installed next to each other along the longitudinal length of the roof structure for mobile homes 10. The roof panels 12 are formed in a trough-like configuration as shown in FIG. 3 and each roof panel 12 is curved as shown in FIG. 2.

The plurality of roof panels 12 are suitably affixed in place by suitable fastening means 30, such as screws, to the stringer 26. The fastening means 30 is shown passing through the top-most part of one of the corrugations in the trough-like configuration of the roof panels 12 as shown in FIGS. 2 and 3. Predrilling for the fastening means 30 may be done in the shop or field. A washer or caulking means may be used under the head of fastening means 30 to prevent leakage.

The plurality of roof panels 12 are also suitably affixed 40 to the top flange 38 of the two soffit support angles 32, such as by bolts and nuts.

Insulation panels 112 are placed over the roof R between the longitudinal support means 14 and the soffit support angles 32. Note in FIG. 2 that the installation of soffit support angles 32 are set so as to leave an air space 31 above the insulation 112 when it is in place.

The insulation panels 112 may be held in place by strap means 114 (as shown in FIG. 1) to maintain the air space 31 (as shown in FIG. 2). The strap means 114 have upturned ends 116 for affixing the ends of the strap means 114 to the web 34 of the soffit angles 32 by suitable fastening means 118, such as sheet metal screws. Shim blocks 120, same material as the insulation panels 112, may also be used over the insulation panels and under the roof panels 12 in order to hold the insulation panels 112 in place, as shown in FIG. 1.

The structural detail and fabrication of the longitudinal support means 14 is shown enlarged in FIG. 7. The structural detail and configuration of the soffit support angle 32 is shown enlarged in FIG. 8.

A modified soffit support means 88 is shown enlarged in FIG. 9. The modified soffit support 88 is used when an awning support means 96 or other object is to be used on the mobile home M. FIG. 9 indicates how the "Z" configuration of the modified soffit support means 88 is suitably affixed to the roof R of the mobile home M with suitable fastening means 92, such as sheet metal screws. Locating, length, positioning, and the elevation of the top flange 94 of the modified soffit support means 88 is essentially the same as when installing the soffit support angle 32. The plurality of fastening means 92 through the lower flange 90 of the modified soffit support means 88 affixes the modified support means 88 to the roof R.

The curved roof panels 12 are affixed to the top flange 94 of the modified soffit support means 88 in the same manner as the roof panels 12 were affixed hereinbefore to the top flange 38 of the soffit support angles 32.

The channel-like awning support means 96 is suitably affixed to the side of the mobile home M, such as by sheet metal screws.

Turning now to FIGS. 1, 2, 4, and 5, an open fascia trim plate means 42 and a gutter means 52 may be added to the eave ends of the plurality of roof panels 12.

The open fascia trim plate means 42 masks the exposed eave ends of the roof panels 12 and at the same time permits leaves and other such debris to wash down with rain, or blow down with wind, such as indicated by the arrow of the aforementioned air circulation shown at the open fascia trim plate means 42.

In a similar manner the gutter means 52 also masks the exposed eave ends of the roof panels 12 and at the same time catches the rain as it flows from the trough-like depressions of the roof panels 12.

It is to be noted that the open fascia trim plate means 42 and the gutter means 52 may be used together as shown in FIG. 2, one on one side of the mobile home M and the other on the opposite side. Or either of the two means may be used as a pair, mounting them on each side of the mobile home M as an alternative to the combination use.

Figure 4:
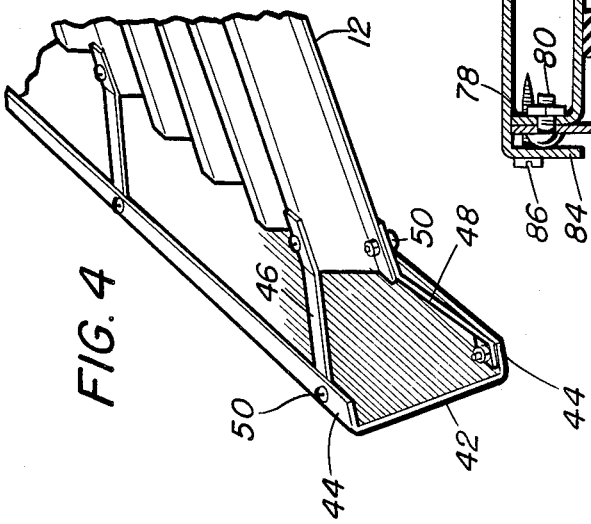
FIG. 4 is a partial perspective detail view of a fascia trim plate at an eave.

The open fascia trim plate means 42 is channel-like in configuration, as seen in FIGS. 2 and 4, and is suitably affixed to the eave ends of the roof panels 12. The open fascia trim plate means 42 is affixed to the roof panels 12 by strap means 46 and 48 which are suitably affixed to the flanges 44 of the open fascia trim plate means 42 and to the roof panels 12 by fastener means 50, such as by bolts and nuts. Note that the upper strap means 46 is affixed to upper portion of the trough-like configuration of the roof panels 12; the lower strap means 48 is affixed to valley portion of the trough-like configuration of the roof panels 12.

Figure 5:
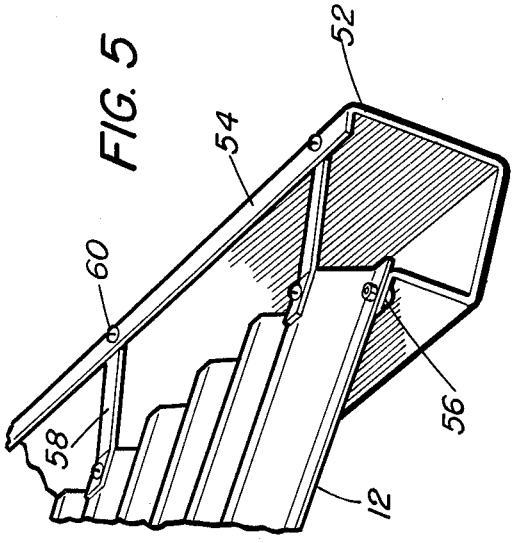
FIG. 5 is a partial perspective detail view of a gutter installation at an eave.

The gutter means 52 has a cross-sectional configuration of an open truncated rectangular box, as shown in FIGS. 2 and 5, with an outer flange 54, turned inwardly, and an inner flange 56, turned outwardly, from the open rectangular-like gutter portion. The inner flange 56 is suitably affixed to the underside of the valley portions of the trough-like configuration of the roof panels 12, by fastening means 60, such as bolts and nuts. The outer flange 54 is suitably affixed to the upper-most portion of the trough-like configuration of the roof panels 12 by strap means 58, by fastener means 60, such as bolts and nuts. The gutter means 52 is suitably connected to suitable downspouts.

Turning now to FIGS. 1 and 6, the end gable 62 fabrication is shown for the roof structure for mobile homes 10.

The fabricated end gable 62 consists of an end gable plate 64, a flashing angle means 72, a cap channel means 82, a plurality of sealant means 74, and a plurality of fastening means described hereinafter.

End gable plate 64 is generally in a "Z" shape configuration, with one leg or flange of the "Z" configuration extremely long in relation to the other leg or flange. The end gable plate 64 has a web 66, a short flange 68, and the other flange, extremely long, set in a vertical position, as shown in FIG. 6.

The short flange 68 is suitably affixed to the gable portion of end wall EW of the mobile home M by a plurality of suitable fastening means 70, such as sheet metal screws.

Flashing angle means 72 is suitably affixed by its short leg 78 to the distal end of the vertical long flange of the "Z"-shaped configuration of end gable plate 64, with a plurality of suitable fastener means 80, such as bolts and nuts. The long leg of flashing angle means 72 is suitably affixed at the distal end thereof to the upper-most portion of the trough-like configuration of the roof panel 12, by suitable fastening means 76, such as sheet metal screws. Before fastening the fastening means 76 in place, a sealant means 74, such as a caulking compound, or a rubber-like gasket, is placed in a plurality of locations under the flashing angle means 72 and between it and the upper-most portion of the trough-like configuration of the roof panel 12 adjacent to the end gable plate 64. The arrangement is shown clearly in FIG. 6.

A cap channel means 82 serves as a trim means and an enclosing means for the fabricated end gable 62. The cap channel means 82 rests on ends of the interfaced long vertical flange of the end gable plate 64 and the short leg 78 of the flashing angle means 72; the cap channel means 82 is then suitably affixed to the aforementioned interfaced flange and leg by a plurality of suitable fastening means 86, such as sheet metal screws, through the flange 84 of the cap channel means 82 and into and through the aforementioned interfaced flange and leg.

As can be seen in FIG. 1, the end gable plate 64 and the cap channel means 82 finish off the structural arrangement at the ends of the open fascia trim plate means 42 and the gutter means 52.

Figure 10:
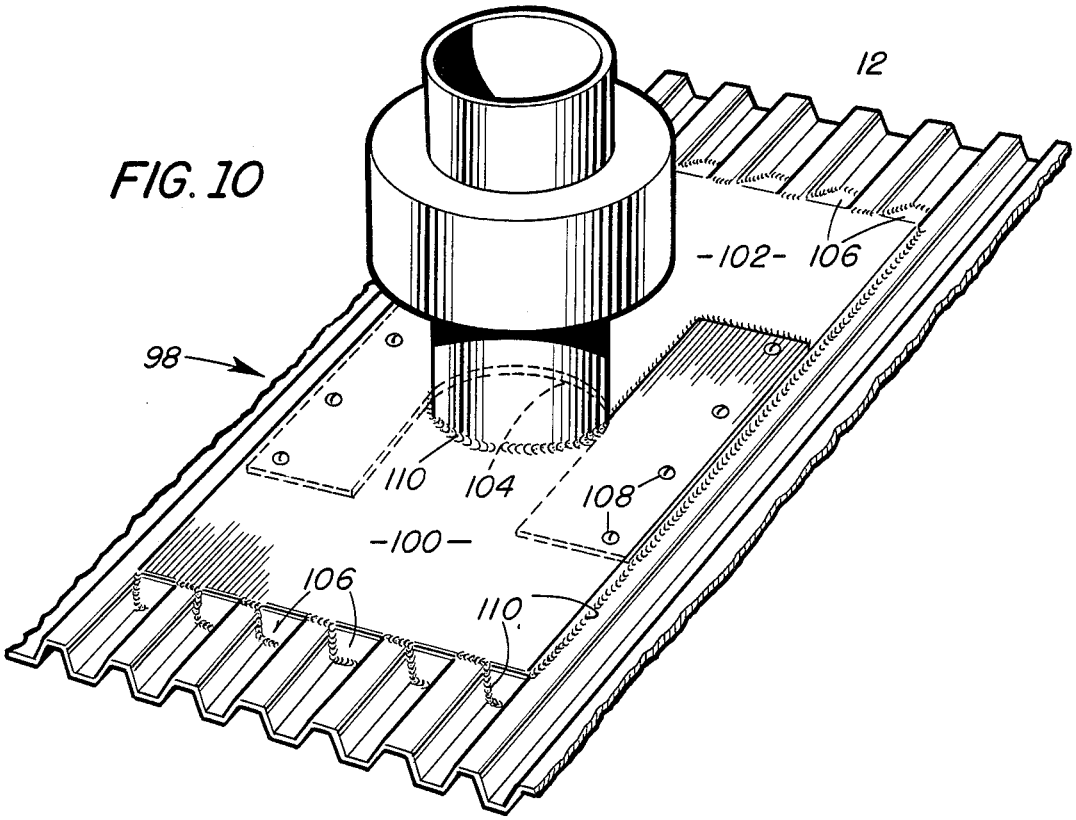
FIG. 10 is a perspective view of a heater stack flashing installation.
Figure 11:
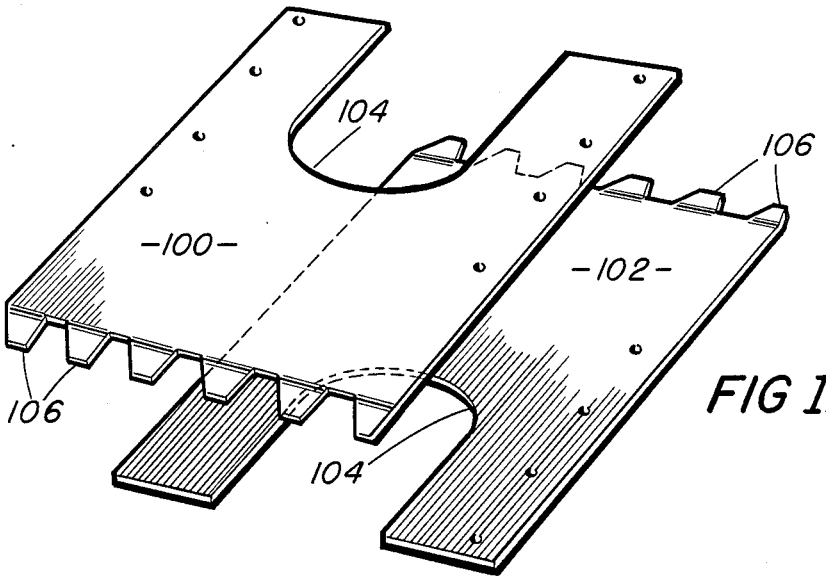
FIG. 11 is an exploded perspective view of heater stack flashing plates of FIG. 10.

FIGS. 10 and 11 show how a flashing arrangement 98 is made around a heater stack of a mobile home M which must pass through the roof panels 12 of a roof structure for mobile homes 10.

The flashing arrangement 98 consists of an upper plate 100 and a lower plate 102, configured and installed as described hereinafter.

The upper and lower plates 100 and 102 respectively, each have a configured notch 104 on one end to fit around the stack when the upper and lower plates 100 and 102, respectively, are slidingly and telescopably placed around the heater stack. The assembly is made so that the projecting ends of the configured notch 104 of the upper plate 100 point downwardly on the slope of the roof panels 12. This arrangement gives projecting ends of the configured notch 104 of the upper plate 100 a shingle like arrangement over the lower plate 102.

The upper and lower plates 100 and 102, respectively, are then affixed in place by fastening means 108, such as sheet metal screws. The holes for the fastening means 108 may be predrilled or drilled in the field at assembly. The fastening means 108 are affixed into the roof panels 12.

On the ends of the upper and lower plates 100 and 102, respectively, opposite the ends having the configured notch 104, a plurality of configured projections 106 are arranged to meet, mate, and match the configuration of the trough-like valleys of the roof panels 12 which lie beneath the assembled upper and lower plates 100 and 102, respectively.

The plurality of configured projections 106 may be bent down in the field into the valleys of the roof panels 12, or they may be pre-bent or partially pre-bent in the shop in preparation for the final fitting or bending into place when assembled in the field.

When assembled in place the configured projections 106 fit neatly into the valleys of trough-like roof panels 12.

A suitable caulking material 110 under and around the edges of the upper and lower plates 100 and 102, respectively, where they fit around the heater stack, where they telescope each other, and where they contact the roof panels 12. Likewise, the caulking material 110 is placed around the edges of the configured projections 106 where they interface with the trough-like valleys of the roof panels 12. In addition, caulking material 110 is under and over the heads of the fastening means 108.

It is to be noted and understood that the aforementioned description of a flashing arrangement 98 for a heater stack is also applicable as a flashing arrangement around vent pipes for plumbing or any other projection through the roof panels 12.

As can be readily understood from the foregoing description of the invention, the present structure can be configured in different modes to provide the facility of a roof structure for mobile homes with some flexibility of erection and adaptability to cover an outdated, worn-out, or inefficient roof or roof section.

Accordingly, modifications and variations to which the invention is susceptible may be practiced without departing from the scope and intent of the appended claims.

What is claimed is:

1. A roof structure for a mobile-type home having an existing roof, comprising:

a center support means, said center support means being a longitudinal support, said center support means consisting of a main body member, a stringer member, a plurality of spacer members, and a plurality of connection members, said main body member having a configuration that is hat-like in cross section, said hat-like configuration being composed of a channel-like portion and two outstanding flange legs, said outstanding flange legs each being a right angle continuation of the longitudinal edge of the each of the flanges of said channel-like portion, said stringer member paralleling the longitudinal length of the web of said channel-like portion, said plurality of spacer members being spaced apart along said web of said channel-like portion and interfacing therewith and between said web and said stringer member with which said plurality of spacer members also interfaces, thereby spacing said stringer member from said web and thereby creating a space for air flow between adjacent said spacer members and between said web and said stringer member, said main body member, said plurality of spacer members, and said stringer member being suitably affixed to each other, said plurality of connection members being strap-like with the ends thereof bent into a clip-like configuration, said clip-like configuration at each end of said strap-like connection member being slidably and removably affixed around said two outstanding flange legs, said plurality of connection members being the means whereby said center support means is suitably affixed to said existing roof of said mobile-type home;

a pair of soffit support means, each of said pair of soffit support means being spaced one to the right and one to the left, respectively, from said center support means, said pair of soffit support means being longitudinal supports, said pair of soffit support means being set at a lower elevation than said center support means;

a plurality of roof panels, each of said plurality of roof panels being located adjacent to each other and having their side edges partially overlapping with the next adjacent roof panel, each of said plurality of roof panels being longitudinally curved in a configuration so as to fit the topmost elevation of said center support means and each of said pair of soffit support means, said plurality of roof panels being suitably affixed to said center support means and to each of said pair of soffit support means.

2. A roof structure as recited in claim 1, wherein said roof structure is suitably affixed upon a mobile-type home over an existing roof as a replacement therefor.

3. A roof structure as recited in claim 2 and additionally, at least two intermediate support means, said intermediate support means being of substantially the same general structure and configuration as said center support means, said intermediate support means individually being located between and spaced from said center support means and said soffit support means and set at an elevation between said elevation of said center support means and said soffit support means, said plurality of roof panels being suitably affixed to said intermediate support means, said intermediate support means being used when the span of said mobile-type home is excessive and requires additional support for said plurality of roof panels.

4. A roof structure as recited in claim 2, wherein the affixation of said roof structure upon and over said existing roof of said mobile-type home is accomplished by suitably affixing said center support means to said existing roof of said mobile-type home and by suitably affixing said paid of soffit support means to the sides of said mobile-type home with one of said pair of soffit support means on each side.

5. A roof structure as recited in claim 4, wherein said pair of soffit support members has an angle-like configuration, said angle-like configuration having a short leg and a long leg, said short leg forming an angle of less than 90° with said long leg, said angle at which said short leg is set matching said curved configuration of said roof panels, said long leg being the means whereby said soffit support means are suitably affixed to said sides of said mobile-type homes.

6. A roof structure as recited in claim 5, wherein one of said pair of soffit support means is configured in a substantially "Z" shape, the top flange thereof being set at an angle to match said curved configuration of said roof panels, the bottom flange thereof being set to match said existing roof configuration of said mobile-type home and suitably affixed thereto, the web of said "Z" shape being vertical and set as to be an upward extension of said side of said mobile-type home, said "Z" shape soffit support means being used when an object on said mobile-type home prevents use of an angle-like configured soffit support means, such as a channel-like awning support.

7. A roof structure as recited in claim 2 and additionally, a plurality of insulation panels, each of said plurality of insulation panels being set side by side and located upon said existing roof of said mobile-type home and thereby under said roof structure, thereby creating an air space between the topmost side of said plurality of insulation panels and the undermost side of said plurality of roof panels.

8. A roof structure as recited in claim 7, wherein the cross sectional configuration of each of said plurality of roof panels is a plurality of adjacent and alternating hills and valleys in corrugated arrangement, the tops of said hills and valleys in corrugated arrangement having the tops of said hills and the bottoms of said valleys flattened.

9. A roof structure as recited in claim 7 and additionally, a plurality of first strap means, said plurality of first strap means being spaced apart and located on top of said insulation panels, said plurality of first strap means having the ends thereof suitably affixed to said pair of soffit support means, thereby holding said plurality of insulation panels in place upon said existing roof of said mobile-type home.

10. A roof structure as recited in claim 1, wherein said stringer member and said plurality of spacer members are wood.

* * * * *